US011007811B2

(12) United States Patent
Berthe et al.

(10) Patent No.: US 11,007,811 B2
(45) Date of Patent: May 18, 2021

(54) DOCUMENT CAPABLE OF GENERATING A COLOR IMAGE

(71) Applicant: IDEMIA FRANCE, Courbevoie (FR)

(72) Inventors: Benoît Berthe, Courbevoie (FR); Coralie Vandroux, Courbevoie (FR)

( * ) Notice: Subject to any disclaimer, the term of this patent is extended or adjusted under 35 U.S.C. 154(b) by 0 days.

(21) Appl. No.: 16/980,445

(22) PCT Filed: Mar. 14, 2019

(86) PCT No.: PCT/FR2019/050569
§ 371 (c)(1),
(2) Date: Sep. 14, 2020

(87) PCT Pub. No.: WO2019/175514
PCT Pub. Date: Sep. 19, 2019

(65) Prior Publication Data

US 2021/0016593 A1 Jan. 21, 2021

(30) Foreign Application Priority Data

Mar. 16, 2018 (FR) ..... 18 52273

(51) Int. Cl.
*B42D 25/435* (2014.01)
*B42D 25/324* (2014.01)
(Continued)

(52) U.S. Cl.
CPC ..... *B42D 25/435* (2014.10); *B42D 25/324* (2014.10); *B42D 25/351* (2014.10);
(Continued)

(58) Field of Classification Search
CPC .... B42D 25/435; B42D 25/324; B42D 25/45; B42D 25/351; B42D 25/41; B42D 25/44
(Continued)

(56) References Cited

U.S. PATENT DOCUMENTS

2014/0028775 A1* 1/2014 Lazzari ..... B41M 3/148 347/232
2019/0033608 A1 1/2019 Zhang
2019/0152250 A1 5/2019 Berthe et al.

FOREIGN PATENT DOCUMENTS

EP 2727742 A1 5/2014
GB 2553104 A 2/2018
(Continued)

OTHER PUBLICATIONS

English language abstract of EP2727742.

*Primary Examiner* — Justin V Lewis
(74) *Attorney, Agent, or Firm* — Yasser Mourtada; Robert Facey; William Salinger

(57) ABSTRACT

The invention proposes a document configured to generate a color image, comprising: a set of pixels printed on or in a substrate, each pixel forming a pattern including an arrangement of sub-pixels of at least two different colors; and an array of lenses disposed opposite the set of pixels so as to generate the color image by focusing or diverging an incident light through the lenses on at least part of the sub-pixels, each lens being positioned, relative to a facing associated pixel, to focus or diverge the incident light on at least one of the sub-pixels of said associated pixel so as to modify the contribution of the respective colors of the sub-pixels of the associated pixel, in a region of the color image generated through said lens, with respect to the pattern intrinsically formed by the associated pixel independently of said lens.

20 Claims, 9 Drawing Sheets

(51) Int. Cl.

| | |
|---|---|
| ***B42D 25/351*** | (2014.01) |
| ***B42D 25/41*** | (2014.01) |
| ***B42D 25/44*** | (2014.01) |
| ***B42D 25/45*** | (2014.01) |

(52) U.S. Cl.
CPC ..... *B42D 25/41* (2014.10); *B42D 25/44* (2014.10); *B42D 25/45* (2014.10)

(58) Field of Classification Search
USPC ..... 283/67, 70, 72, 74, 87, 94, 98, 109, 110, 283/901
See application file for complete search history.

(56) References Cited

FOREIGN PATENT DOCUMENTS

| | | | |
|---|---|---|---|
| WO | 2005/052650 | A2 | 6/2005 |
| WO | 2005/106601 | A2 | 11/2005 |
| WO | 2015/178894 | A1 | 11/2015 |
| WO | 2016/097608 | A1 | 6/2016 |
| WO | 2017/162006 | A1 | 9/2017 |

* cited by examiner

DOCUMENT CAPABLE OF GENERATING A COLOR IMAGE

BACKGROUND OF THE INVENTION

The invention relates to the field of the formation of color images and relates more particularly to a device or an object, such as a document for example, able to generate a customized color image.

The invention finds particular applications in the formation of identity images in identity documents such as official documents: identity cards, credit cards, passports, driving licenses, secure entry badges, etc.

Various printing techniques have been developed over time to perform color prints. The production particularly of identity documents such as those mentioned above require the production of color images in a secure manner in order to limit the risks of tampering by malicious individuals. The manufacture of such documents, particularly at the identity image of the bearer, needs to be sufficiently complex to make reproduction or tampering by an unauthorized individual difficult.

Thus, in a known manner, some official documents for example include guilloches representing a pattern by means of a complex set of printed lines, difficult to reproduce without sophisticated equipment and adequate expertise. Various security elements (hologram, secure inks, etc.) have been developed but these are not always sufficient to prevent fraud, in particular in relation to the significant resources available to some counterfeiters today.

Furthermore, the color image formation techniques used today, in particular in secure identity documents, do not always allow obtaining a satisfactory visual rendering quality. Problems arise in particular when the image formation techniques used are limited in their ability to saturate some colors. In other words, the color gamut (ability to reproduce a range of colors) of the known color image formation techniques is sometimes limited.

When, for example, an identity image is created on a document, it is generally composed of a face surrounded by a light, even white, area constituting the image background. It is not always possible to obtain sufficiently saturated colors on the facial area or on the background, so that this same face placed on a monochrome background for example, and not sufficiently clear, has a satisfactory contrast between this face and the background fully satisfactory for the observer.

There is now a need to securely form customized color images, for example in identity documents, such as those mentioned above in particular. A need exists particularly to allow flexible and secure customization of color images in documents or the like, so that, even if a document is illicitly obtained by an individual, the latter cannot customize the color image as he wishes without being detectable during a proper inspection.

Furthermore, no solution capable of offering an appropriate level of security and flexibility today allows obtaining a sufficient color gamut, particularly to obtain the shades of color necessary for the formation of some high-quality color images, in particular when image areas must have a highly saturated level in a given color or for example a very light identity image background, that is to say totally desaturated and bright.

OBJECT AND SUMMARY OF THE INVENTION

The invention aims in particular at overcoming the drawbacks and shortcomings of the state of the art mentioned above.

To this end, the present invention relates to a document suitable to generate a color image, comprising:

- a set of pixels printed on or in a substrate, each pixel forming a pattern including an arrangement of sub-pixels of at least two different colors; and
- an array of lenses disposed opposite the set of pixels so as to generate the color image by focusing or diverging an incident light through the lenses on at least part of the sub-pixels, each lens being positioned, relative to a facing associated pixel, to focus or diverge the incident light on at least one of the sub-pixels of said associated pixel so as to modify the contribution of the respective colors of the sub-pixels of the associated pixel, in a region of the color image generated through said lens, with respect to the pattern intrinsically formed by the associated pixel independently of said lens.

The invention advantageously allows, thanks to the lenses, creating shades of colors so as to form a color image by the interaction between the array of lenses and the set of pixels. The color image is therefore formed by the combination of the array of lenses and the facing set of pixels. Without the addition of the lenses to judiciously orient the incident light, the set of pixels is only a blank arrangement of color pixels insofar as this set lacks the information characterizing the color image. It is the array of lenses that is configured, according to the chosen arrangement of sub-pixels, to customize the visual appearance of the pixels and thus generate, by juxtaposition of the visual appearances of the pixels, the final color image.

It is particularly possible to configure the lenses (shape, positioning, etc.) so as to select some colors among the different colors present in the set of pixels. Conversely, it is possible to mask or reduce the color contribution of some sub-pixels in the visual rendering of the final color image 6.

The invention in particular allows generating a color area highly saturated in the desired color or even desaturated in the particular case where the targeted sub-pixel is white in color.

The invention thus allows forming monochrome image areas of good quality, while ensuring a high level of complexity guaranteeing the security of the image against fraud. The invention allows, for example, producing a highly saturated or desaturated image background in a given color, such as white for example.

By implementing the principle of the invention, it is possible to easily detect fraud when the image has been tampered or illicitly reproduced. Furthermore, this level of complexity and security of the image achieved by the invention does not come at the expense of the quality of the visual rendering of the image. This does not prevent particularly the formation of color images comprising areas that require high contrast as in the case of a face facing an image background. The invention allows forming quality color images from a wide color gamut.

According to a particular embodiment, each pixel of said set of pixels forms an identical pattern of color sub-pixels.

According to a particular embodiment, the set of pixels is configured so that the sub-pixels are uniformly distributed on or in the substrate.

According to a particular embodiment, each pixel of said set of pixels is configured so that each sub-pixel has a single color in said pixel.

According to a particular embodiment, the array of lenses is formed from a layer including surface deformations defining the micro-lenses, said layer being the substrate or a layer laminated with the substrate.

According to a particular embodiment, the sub-pixels in the set of pixels include a reflecting surface positioned under the sub-pixels to reflect the incident light through the array of lenses.

According to a particular embodiment, at least one lens in the array of lenses is a converging lens configured to focus the received incident light so as to enhance the color contribution of at least one sub-pixel of the associated pixel, in the corresponding region of the color image generated through said lens, with respect to the respective color contribution of each other sub-pixel of said associated pixel.

According to a particular embodiment, at least one lens in the array of lenses is a converging lens configured to focus the received incident light on only one of the sub-pixels of the associated pixel so as to mask the color of each other sub-pixel of said associated pixel in the corresponding region of the color image generated through said lens.

According to a particular embodiment, in a monochrome region of the color image, each lens of the array of lenses is a converging lens configured to focus the received incident light on a single sub-pixel of the same predetermined color in the associated pixel, so as to make appear as a single color the predetermined color in said monochrome region of the color image.

According to a particular embodiment, at least a first lens of the array of lenses is a converging lens configured to focus the received incident light on at least two sub-pixels of the associated pixel so as to make appear in a corresponding region of the color image a hybrid color resulting from a combination of the colors of said at least two sub-pixels, wherein said first lens has, in its smallest dimension, a smaller maximum dimension of 150 μm.

According to a particular embodiment, at least one lens of the array of lenses is a diverging lens configured to diverge a received incident light by the lens so as to reduce the color contribution of at least one sub-pixel of the associated pixel, in the corresponding region of the color image generated through said lens, with respect to the respective color contribution of each other sub-pixel of said associated pixel.

According to a particular embodiment, the document further comprises:

a transparent laserable layer disposed opposite the set of pixels, said transparent laserable layer being at least partially carbonized by laser radiation so as to comprise locally opacified regions opposite sub-pixels to produce gray levels in the color image generated through the lenses.

According to a particular embodiment, the probability density of the presence of each sub-pixel color is constant in the set of pixels.

The invention also relates to a method for generating an image in a document as defined above.

More particularly, the invention relates to a method for generating a color image, comprising:

printing a set of pixels on or in a substrate, each pixel forming a pattern including an arrangement of sub-pixels of at least two different colors; and forming an array of lenses disposed opposite the set of pixels so as to generate the color image by focusing or diverging an incident light through the lenses on at least part of the sub-pixels, each lens being positioned, relative to a facing associated pixel, to focus or diverge the incident light on at least one of the sub-pixels of said associated pixel so as to modify the contribution of the respective colors of the sub-pixels pixels of the associated pixel, in a region of the color image generated through said lens, with respect to the pattern intrinsically formed by the associated pixel independently of said lens.

It will be noted that the various embodiments mentioned above in relation to the document of the invention as well as the associated advantages apply in a similar manner to the generation method of the invention.

According to a particular embodiment, the method comprises:

providing a first transparent layer; and projecting on the first transparent layer a first laser radiation so as to form the lenses by surface deformation of said first transparent layer.

According to a particular embodiment, the method comprises:

providing a first transparent layer; and making on the first transparent layer a projection of transparent material by using a 3D printer head so as to form lenses on the surface of the first transparent layer.

According to a particular embodiment, during the formation step, each lens is positioned relative to the facing associated pixel independently of the positioning of the other lenses of said array of lenses.

According to a particular embodiment, at least a first lens of the array of lenses is a converging lens configured to focus the received incident light on at least two sub-pixels of the associated pixel so as to make appear in a corresponding region of the color image a hybrid color resulting from a combination of the colors of said at least two sub-pixels, wherein said first lens is formed such that it has, in its smallest dimension, a smaller maximum dimension of 150 μm.

According to a particular embodiment, the method comprises determining respective weights assigned to each of said at least two sub-pixels, said weights representing respective contributions of each sub-pixel in the combination of the colors producing the hybrid color;

said first lens being configured relative to the associated pixel in accordance with said respective weights assigned to said at least two sub-pixels.

BRIEF DESCRIPTION OF THE DRAWINGS

Other characteristics and advantages of the present invention will emerge from the description given below with reference to the appended drawings which illustrate exemplary embodiments thereof without limitation. In the figures.

DETAILED DESCRIPTION OF SEVERAL EMBODIMENTS

Figure 1:
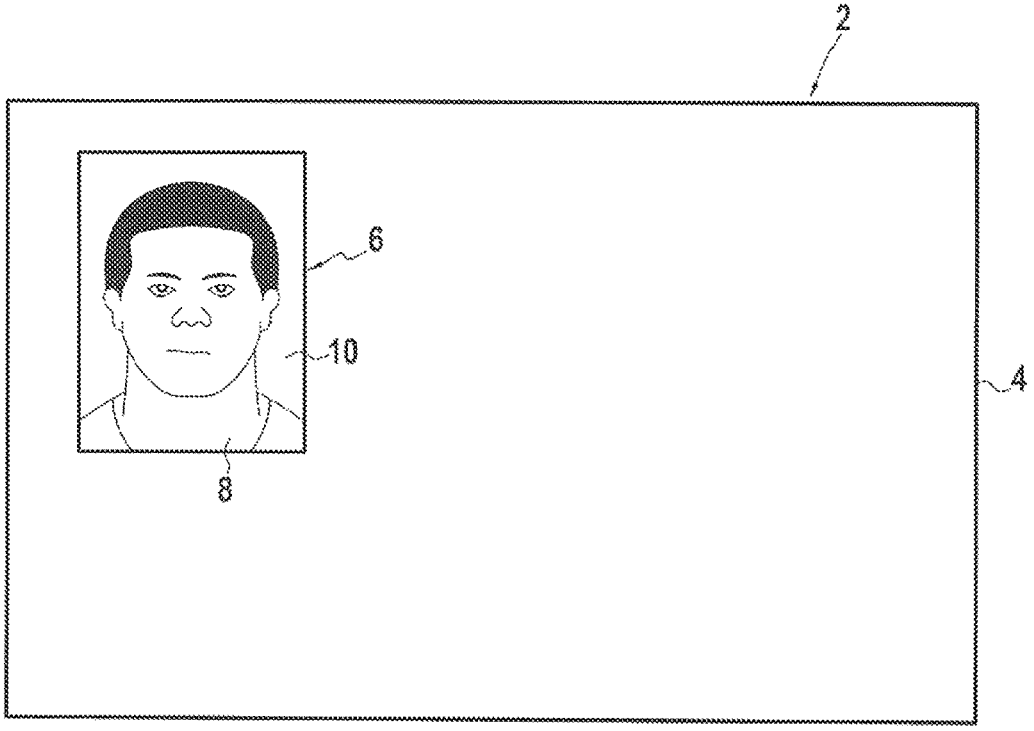
FIG. 1 schematically represents a document according to a particular embodiment of the invention.

As indicated above, the invention relates to the formation of color images and particularly relates to a device or an object, such as a document for example, able to generate a customized color image from color pixels.

The device within the meaning of the invention can take various forms and have various functions, one characteristic being that it is able to generate a color image according to the principle of the invention as disclosed in this document.

In the remainder of this document, exemplary implementations of the invention are described in the case of a document able to generate a color image according to the principle of the invention. This document can be any document, of the booklet or card type or the same, in particular an identity document such as for example: an identity card, a credit card, a passport, a driving license, a secure entry badge, etc.

It is however understood that the invention is not limited to the documents, but also applies to other objects configured to generate a color image according to the principle of the invention.

Likewise, the examples described below aim at generating an identity image. It is however understood that the considered image can be any image. Particularly, the image may be monochrome or multicolored (or include a monochrome or multicolored region).

The invention proposes to manufacture customized color images which are highly secure and which have good image quality. To do so, the invention, according to various embodiments, implements a device able to generate a color image, comprising: a set of pixels printed on or in a substrate, each pixel forming a pattern including an arrangement of sub-pixels of at least two different colors; and a array of lenses disposed opposite the set of pixels so as to generate the color image by focusing or diverging an incident light through the lenses on at least part of the sub-pixels.

Each lens can be positioned (or configured), relative to a facing pixel (called "associated pixel"), to focus or diverge the incident light on at least one of the sub-pixels of said associated pixel so as to modify the contribution of the respective colors of the sub-pixels of the associated pixel, in a region of the color image generated through the lens, with respect to the pattern intrinsically formed by the associated pixel independently of (or without) said lens.

In other words, each lens can be positioned (or configured), relative to a facing associated pixel, to focus or diverge the incident light on at least one of the sub-pixels of said associated pixel so as to modify the contribution of the respective color of at least one sub-pixel of the associated pixel, in a region of the color image corresponding to said pixel, with respect to the respective color contribution of each other sub-pixel of said associated pixel.

The lenses thus allow creating shades of color so as to form (or generate) a color image by the interaction between the array of lenses and the set of pixels. More particularly, each array of lenses allows creating shades of color, so as to form a single color image, specific to each array and distinct from the pattern of the pixels. The invention also relates to a corresponding method for manufacturing (or generating) a color image.

Other aspects and advantages of the present invention will emerge from the exemplary embodiments described below with reference to the drawings mentioned above.

Unless otherwise indicated, the elements common or similar to several figures bear the same reference signs and have identical or similar characteristics, so that these common elements are generally not described again for the sake of simplicity.

FIG. 1 schematically represents a device 2 according to an exemplary embodiment of the invention. In this example, device 2 is a document including an identity image 6 formed in or on a device body (or substrate) 4. In this example, document 2 takes the form of a card although other embodiments are possible.

The color image 6 represents in this example a face 8 surrounded by an image background 6 which is monochrome, white or pale blue for example.

Figure 2:
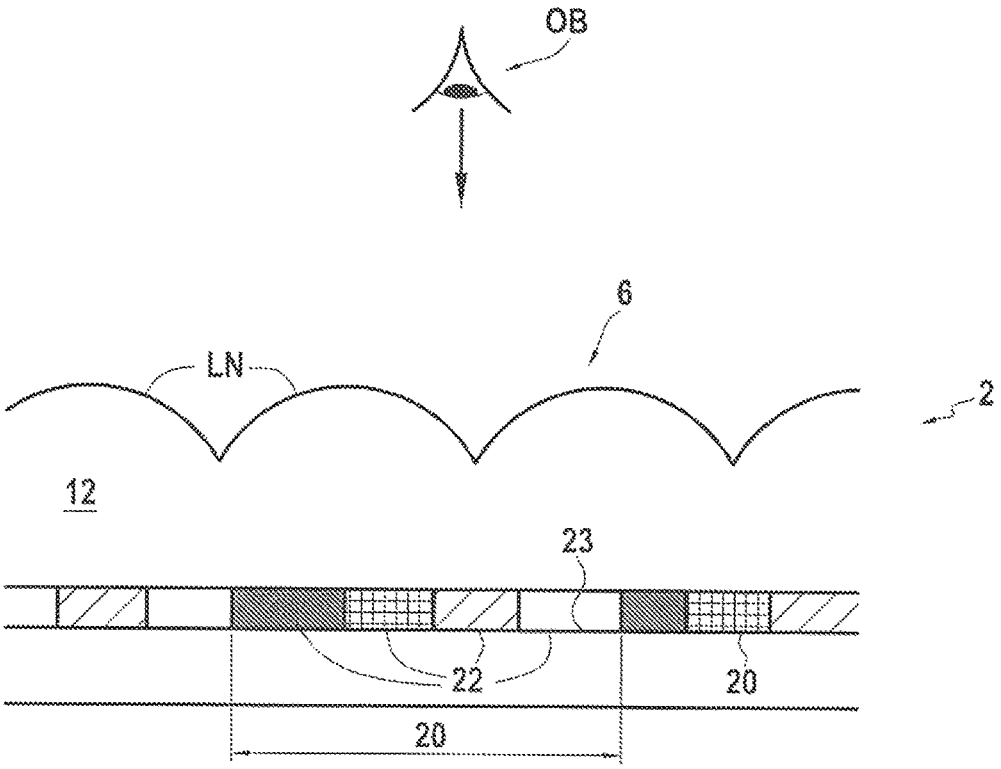
FIG. 2 is a sectional view schematically representing a document according to a particular embodiment of the invention.

FIG. 2 is a sectional view schematically representing the color image 6 formed in document 2 represented in FIG. 1, according to a particular embodiment. More particularly, document 2 includes a substrate 12 in or on which an array (or arrangement) of lenses LN is disposed.

A set of pixels 20, also called tiling (or tiling of pixels), is printed in the substrate 12, each pixel 20 forming a pattern including an arrangement of sub-pixels 22 of at least two different colors. Examples of patterns of sub-pixels, whose possible configurations are multiple, are described later in particular with reference to FIGS. 3A-3D.

The substrate 12 is here transparent in order to allow an incident light to pass at least partially through the lenses LN so as to reach the color pixels 20. The pixels 20, and more particularly their sub-pixels 22, include in this example a reflecting surface 23 located under the sub-pixels to reflect (at least partially) the received incident light through the array of lenses LN. This reflecting surface is for example a white surface.

As represented in FIG. 2, the array of lenses LN is disposed opposite the set of pixels 20 so as to generate the color image 6 (FIG. 1) by focusing or diverging an incident light through the lenses LN on at least part of the sub-pixels 22. As described below, the lenses can be configured in different ways and, particularly, can be converging and/or diverging depending on the case. In the considered example, the lenses LN are converging in order to converge the incident light on at least one of the sub-pixels 22 of the facing associated pixels 20.

More particularly, each lens LN is positioned, relative to a facing pixel 20, called "associated" pixel, to focus or diverge the incident light on at least one of the sub-pixels 22 of the associated pixel 20 so as to modify the contribution of the respective colors of the sub-pixels 22 of the associated pixel 20, in a region of the corresponding color image 6 (that is to say generated through this lens LN), with respect to the pattern intrinsically formed by the associated pixel 20 independently of said lens LN.

In other words, the lenses LN are configured so as to converge or diverge the incident light on some sub-pixels 22 so as to the make the color image 6 appear (reveal it), from the set of pixels 20, while favoring the color contribution of some sub-pixels over others.

The LN lenses thus allow creating shades of colors so as to form a color image 6 by the optical interaction between the array of lenses LN and the set of pixels 20. The color image 6 is therefore formed by the combination of the array of lenses LN and the facing set of pixels 20. Without the addition of the lenses LN to judiciously orient the incident light, the set of pixels 20 is only a blank arrangement of color pixels insofar as this set lacks the information characterizing the color image 6. It is the array of lenses LN that is configured, according to the chosen arrangement of sub-pixels 22, to customize the visual appearance of the pixels 20 and thus generate, by juxtaposition of the visual appearances of the pixels, the final color image 6.

How the lenses can guide the incident light to modify the color contribution of some sub-pixels 22 with respect to other sub-pixels in the final color image 6 is described in more detail later.

It is particularly possible to configure the lenses LN (shape, positioning, etc.) so as to select some colors among the various colors present in the set of pixels 20. Conversely, it is possible to mask or reduce the color contribution of some sub-pixels 22 in the visual rendering of the final color image 6.

As described below, it is possible to further add opacifying elements (black or dark, for example) opposite some sub-pixels 22 in order to create levels of gray of the resulting color image 6, and thus generate contrast in the color image after the alignment of the lenses on the appropriate sub-pixels has selected an appropriate tint.

The lenses LN disposed opposite the set of pixels 20 can have various shapes, dimensions and configurations (magnifying power, converging or diverging . . . ). Depending on the case, lenses LN can for example be spheroidal or cylindrical, for example.

Furthermore, the set of pixels 20 within the meaning of the invention can be in different shapes, configurations, dimensions, etc. Particularly, each pixel of the set of pixels 20 may form an identical pattern of color sub-pixels 22. In this case, the set of pixels consists of a single pattern of sub-pixels which is repeated a plurality of times. This arrangement of sub-pixels is said to be "blank" arrangement in the sense that it does not intrinsically form (that is to say without the addition of the lenses LN and/or of the opacifying elements) the color image 6.

According to a particular example, each pixel 20 has an identical pattern of sub-pixels 22 in the same orientation through the set of pixels 20. It is thus possible to evenly distribute the color sub-pixels in the set of pixels (as illustrated for example in FIG. 3A), which facilitates the formation of the lenses insofar as the same frame of reference (or the same disposition) is used in each pixel.

According to a particular example, each pixel 20 has an identical pattern of sub-pixels 22, variations in orientation of this pattern being however made between some pixels with respect to each other, through the set of pixels 20. In other words, the same pattern of color sub-pixels 22 is then in all the pixels 20 of said set but following at least two different orientations (by applying for example rotations of 90° and/or 180° on the same pattern which is repeated through the set of pixels 20). FIG. 3C thus illustrates an example in which the same pattern of color sub-pixels 22*a*-22*d* is in two different orientations (rotation of 180°) in the set of pixels 20. This variant thus allows forming a blank set of color sub-pixels offering the flexibility necessary to generate any image through the lenses LN, while allowing the same pattern to be incorporated in variable orientations to form for example a signature or a secure element, specific to each color image, which is difficult to reproduce and easily detectable in case of fraud.

The set of pixels 20 can be configured so that the sub-pixels are uniformly distributed on or in the substrate 12. In other words, the set of pixels can form a regular or periodic arrangement of pixels 22, forming identical or non-identical patterns of sub-pixels depending on the case.

The set of pixels 20 can form a matrix of pixels, consisting of rows and columns of sub-pixels 22. These rows and columns can be rectilinear and optionally orthogonal to each other.

According to a particular example, each pixel 20 forms a pattern composing an arrangement of sub-pixels 22 of at least two different colors, the probability density of the presence of each sub-pixel color being constant in the pixels 20 of the arrangement of pixels. In other words, if pixels 20 of n color sub-pixels are considered (n being an integer), the surface proportion of each color (formed by one or several sub-pixel(s)) is identical in each pixel 20 of the set of pixels. By way of example, the following densities can be found in each pixel 20: 30% yellow, 20% magenta, 40% cyan and 10% white). In this particular example, each pixel 20 can thus have an identical pattern of color sub-pixels 22 in the same orientation through the arrangement of pixels 20 or, optionally, in an orientation that varies in the arrangement of pixels 20 (according to random variations or according to regular variations or other variations).

Particularly, in more complex examples, a random arrangement of the pixels 20 is possible. It is in particular possible to organize the distribution of the sub-pixels 22 randomly but so that the probability density of the presence of each sub-pixel color is constant in the pixels 20 of the set of pixels. In this case, it is necessary, in a given area of the arrangement of pixels 20, to be able to select by means of the lenses LN the desired color(s) even if the corresponding sub-pixels are not exactly at their assumed theoretical coordinates.

According to a particular example, each pixel 20 of the set of pixels is configured so that each of the sub-pixels 22 has a single color in said pixel 20. A pixel 20 can thus be composed of a plurality of sub-pixels 22, all of distinct color. Alternatively, it is possible to define the pixels 20 so that they include at least two sub-pixels 22 of the same color among all their sub-pixels (for example, 2 sub-pixels in each primary color), provided that each pixel comprises at least two sub-pixels 22 of different color.

The colors of the sub-pixels 22 may vary depending on the case and may constitute primary colors from which the color image 6 is generated in combination with the array of lenses LN. In a particular example, each pixel 20 comprises sub-pixels 22 in the primary red/green/blue (RGB) colors, optionally with white, or in the primary yellow/magenta/cyan colors, optionally with white. A white area can optionally be arranged in the arrangement of pixels 22 between the rows and columns of sub-pixels 22 to avoid the color overlay.

Particular examples of tiling (arrangement) of pixels 20, which can be implemented in a device of the invention such as document 2 represented in FIGS. 1-2, are now described with reference to FIGS. 3A, 3B, 3C and 3*d*. It should be noted that these implementations are presented only by way of non-limiting examples, many variants being possible in particular in terms of arrangement and shape of the pixels and sub-pixels as well as of the colors assigned to these sub-pixels.

Figure 3A:
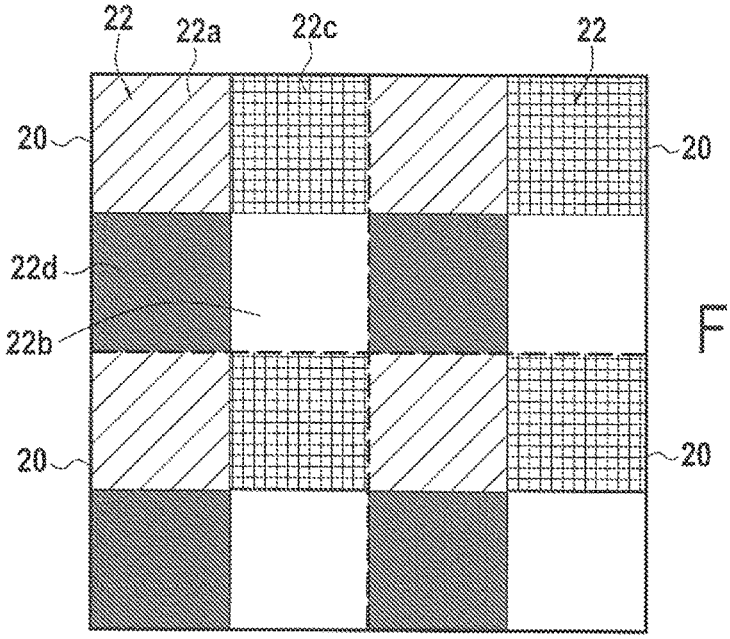
FIGS. 3A to 3D schematically represent sets of pixels according to particular embodiments of the invention.

FIG. 3A is a top view representing a set of pixels 20 according to a particular embodiment. In this example, the tiling forms a matrix of rows and columns of pixels, orthogonal to each other. Each pixel 20, of square shape, forms a pattern composed of 4 sub-pixels 22, noted 22*a* to 22*d*, also of square shape. In this example, the sub-pixels 22 all have a single color in the considered pixel 20. The pixels 20 are uniformly distributed so that the same pattern of sub-pixels 22 is periodically repeated in a region of the substrate 12.

Figure 3B:
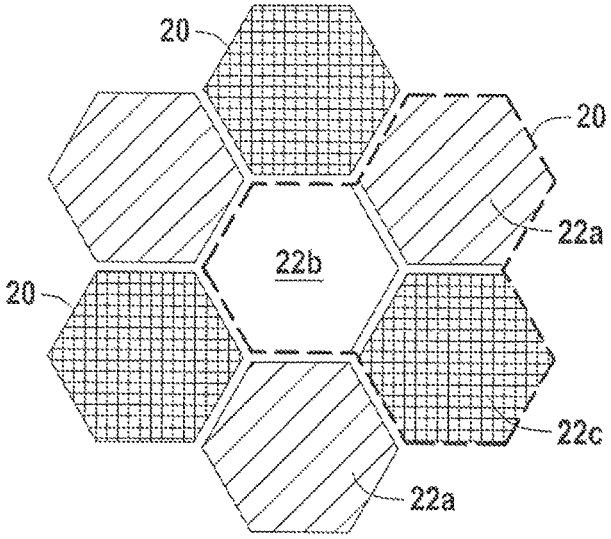
Figure 3C:
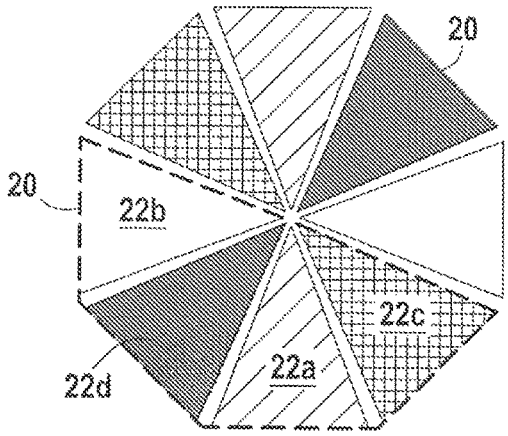

FIG. 3B is a top view representing another example of regular tiling in which each pixel 20 is composed of 3 sub-pixels 22, noted 22*a* to 22*c*, each of a distinct color. The sub-pixels 22 are here of hexagonal shape.

FIG. 3C is a top view representing another example of regular tiling in which each pixel 20 is composed of 4 sub-pixels 22, noted 22*a* to 22*d*, each of a distinct color. The sub-pixels 22 are here of triangular shape.

Figure 3D:
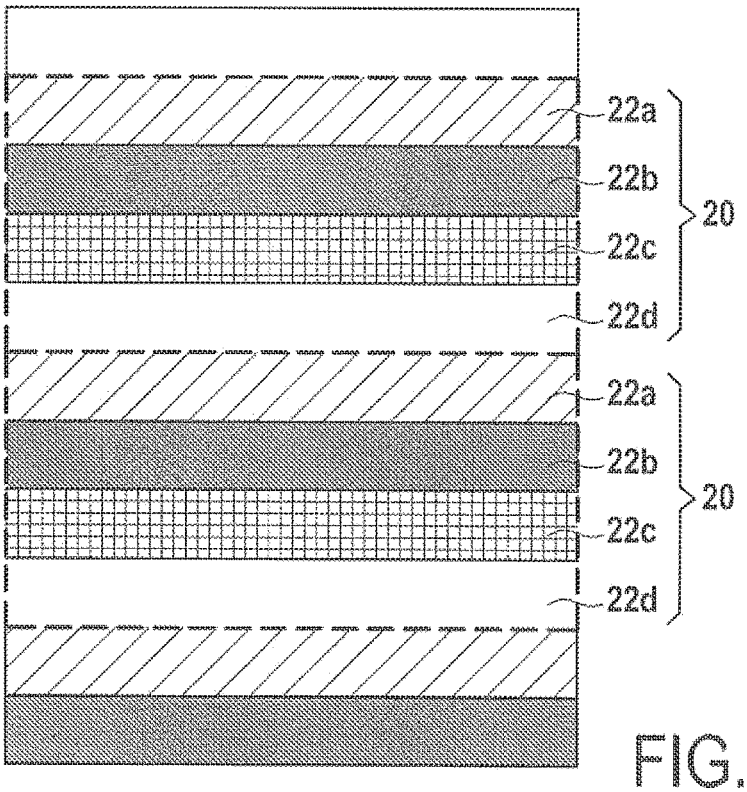

FIG. 3D is a top view representing another example of regular tiling in which each pixel 20 is composed of 4 sub-pixels 22, noted 22*a* to 22*d*, each of a distinct color. The sub-pixels 22 are here of rectangular shape and are arranged in a line, that is to say arranged parallel to each other in order to form rectilinear columns of sub-pixels.

Examples of particular implementation of the device 2 described above with reference to FIGS. 1, 2 and 3A-3D are now described below. More particularly, a first particular implementation of document 2 (FIG. 1) is described with reference to FIGS. 4 to 8.

The device 2 comprises in this example a substrate 12 in which a set of pixels 20 is disposed, each pixel comprising a plurality of sub-pixels 22. An array of lenses, noted here LN1, is disposed opposite the set of pixels 20 so as to generate the color image 6 (FIG. 1) by focusing an incident light 30 on some sub-pixels 22.

Figure 4:
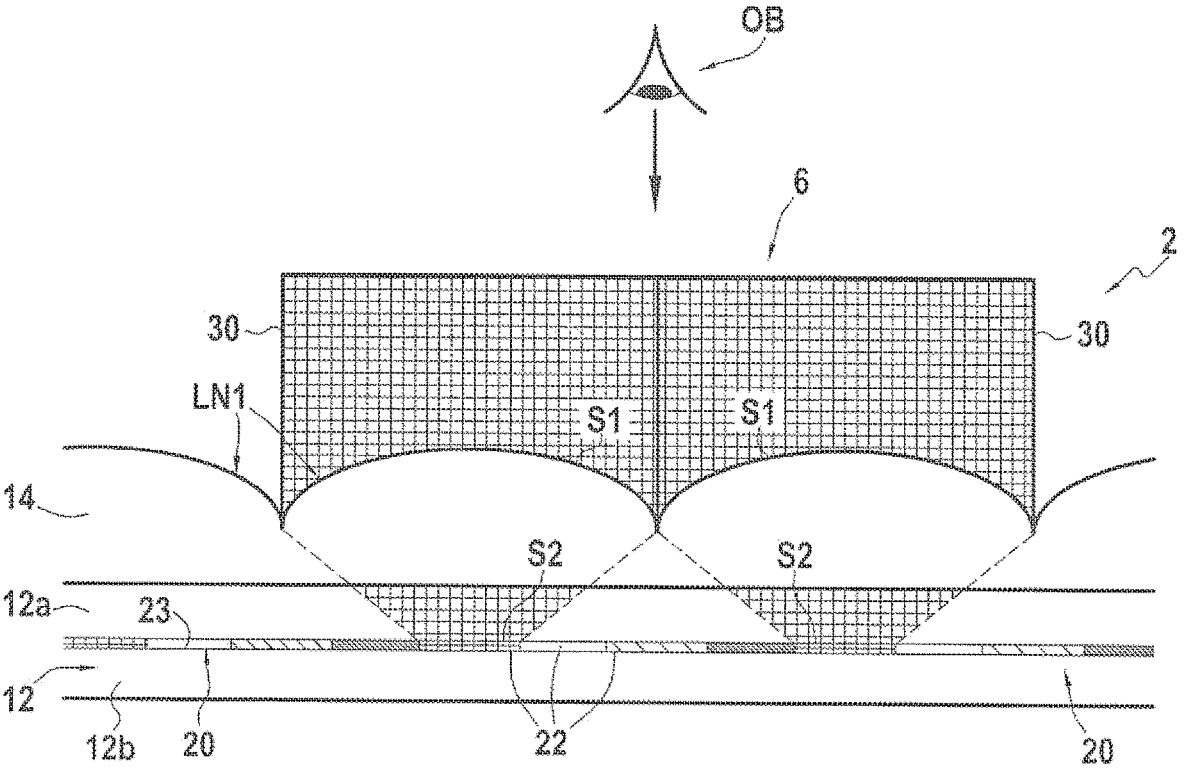
FIG. 4 is a sectional view along IV schematically representing a document according to a particular embodiment of the invention.
Figure 5:
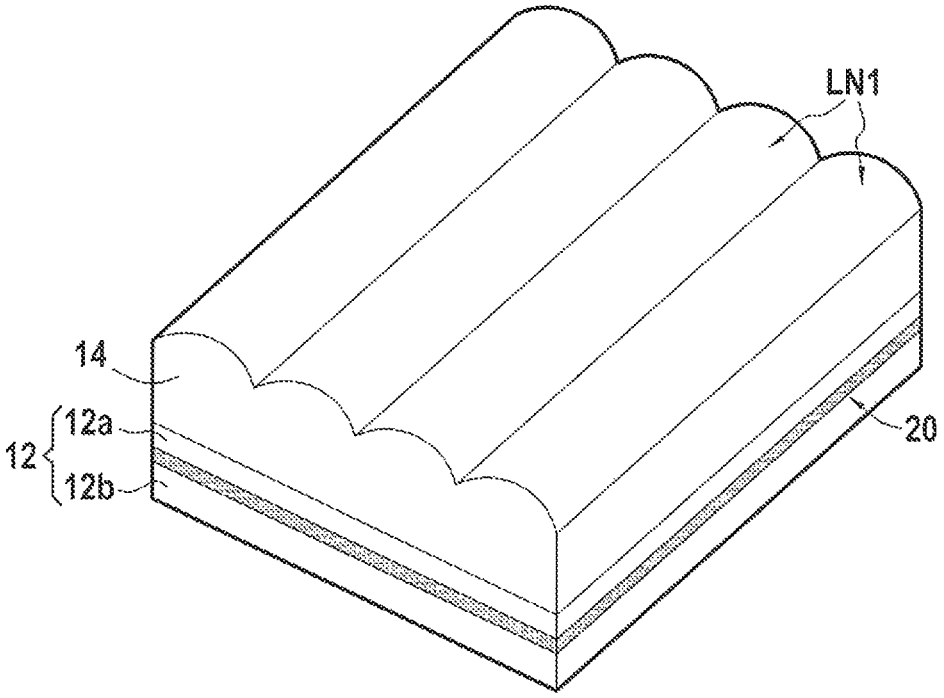
FIG. 5 is a perspective view schematically representing the document of FIG. 4, according to a particular embodiment of the invention.

More particularly, as illustrated in FIGS. 4 and 5, the substrate 12 comprises in this example a transparent upper layer 12*a* disposed on a white lower layer 12*b*. The set of pixels 20 is printed on the upper face of the lower layer 12*b* or on the lower face of the upper layer 12*a*, so as to be at the interface between the layers 12*a* and 12*b*, inside the substrate 12. According to one variant, the set of pixels 20 is printed on the upper face of the substrate 12.

As already indicated, each pixel 20 forms a pattern including an arrangement of sub-pixels 22 of at least two different colors. The sub-pixels 22 can be made using any color printing technique that those skilled in the art can choose depending on the case. The set of pixels 20 used in this example is described later with reference to FIG. 6.

In this example, lenses LN1 are formed in a layer 14 including surface deformations defining the lenses. This layer 14 covers the substrate 12, the layer 14 and the substrate 12 being for example laminated together. The layer 14 can be for example made of silica glass or polycarbonate, or even any transparent material with a density different from that of the air so that there is refraction of light and therefore a lens effect. According to one variant, the array of lenses LN1 is formed directly in the substrate 12 which then includes surface deformations defining the lenses, no additional layer 14 then being necessary.

Figure 6:
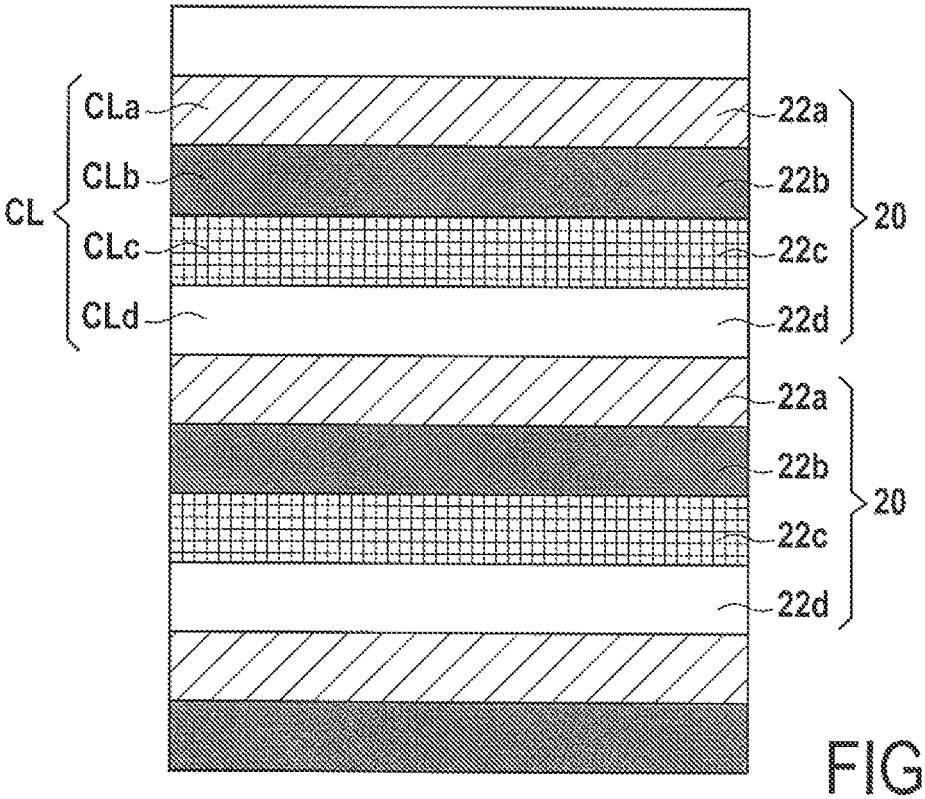
FIGS. 6 and 7 are top views schematically representing the set of pixels of the document of FIG. 4, according to a particular embodiment of the invention.

As illustrated in FIGS. 5-6, the lenses LN1 are here of cylindrical shape and extend parallel to each other.

The lenses LN1 are in this example converging lenses. The array (or arrangement) of lenses LN1 is disposed opposite the set of pixels 20 so as to generate the color image 6 by focusing an incident light 30 through the lenses on at least part of the sub-pixels. 22. Each lens LN1 is positioned, relative to a facing associated pixel 20, to focus the incident light 30 on at least one of the sub-pixels 22 of the associated pixel 20 so as to modify (or modulate) the contribution of the respective colors of the sub-pixels 22 of the associated pixel 20, in a region of the color image 6 generated through said lens LN1, with respect to the pattern intrinsically formed by the associated pixel 20 independently of said lens LN1.

In this document, it is meant by "pattern intrinsically formed by a pixel" a pattern formed by the colors of the sub-pixels of said pixel, this pattern being considered as such, without taking into account the modulation effect resulting from the positioning of a facing lens.

As already explained, the substrate 12 and the layer 14 are transparent in order to allow the incident light to pass least partially through the lenses LN1 until reaching the color pixels 20. The pixels 20, and more particularly their sub-pixels 22, include in this example a reflecting surface 23, located under the sub-pixels, to reflect (at least partially) the received incident light 30 through the array of lenses LN1. The layers 12 and 14 are for example made of polycarbonate. The reflecting layer 23 can be a white surface located under the pixels.

As represented in FIG. 4, each lens LN1 includes an incidence surface (or lens surface) S1, able to receive an incident light 30, and further defines, on the surface of the set of pixels 20, a useful surface S2 on which the lens LN1 converges (guides) the incident light 30. Each lens LN1 is positioned opposite a pixel 20 associated therewith, the lens LN1 being disposed so that its useful surface S2 is positioned on at least part of one or more of the sub-pixels 22 of the associated pixel 20.

The lenses LN1 thus focus the received incident light 30 so as to enhance the color contribution of at least one sub-pixel 22 of the associated pixel 20, in the corresponding region of the color image generated through said lens, with respect to the respective color contribution of each other sub-pixel 22 of the associated pixel 20. This modulation of the colorimetric contributions of the sub-pixels is described in more detail below with reference to FIGS. 6, 7 and 8.

The set of pixels 20 used in the example considered here is illustrated in FIG. 6. The pixels 20 are rectangular and composed of 4 sub-pixels 22*a*-22*d*, themselves of rectangular shape. Each sub-pixel 22*a*-22*d* of the same pixel 20 has a single color noted CLa-CLd respectively. The sub-pixels 22 are uniformly distributed so that the colors CLa to CLd are repeated periodically in the substrate 12. This rectangular configuration has the advantage of being relatively simple to achieve by color printing.

According to one variant, fine white lines, for example less than 30 μm in width, are arranged between the different color sub-pixels CLa, CLb, CLc and CLd.

According to one variant, one among the colors CLa, CLb, CLc and CLd is white.

Figure 7:
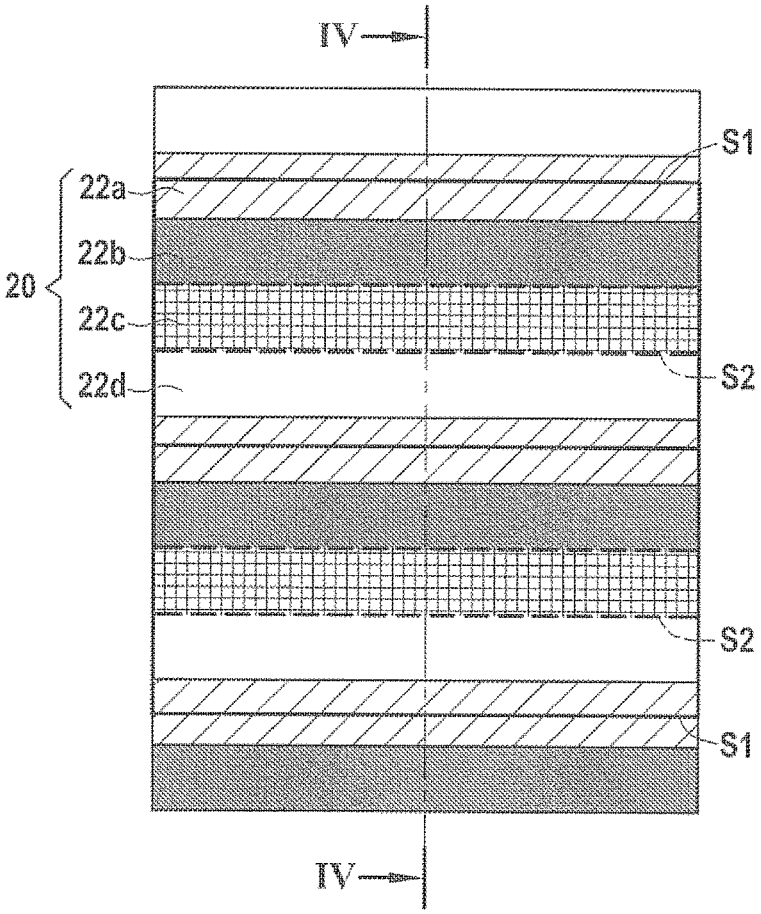

FIG. 7 represents in dotted lines the useful surface S2 defined by each lens LN1 on an associated pixel 20. In this example, the contour of the useful surfaces S2 corresponds to the color CLc sub-pixels 22*c*. In a variant, the useful surface S2 is smaller than the corresponding sub-pixel such that the observed color does not vary when the observer looks at the surface of the lenses at an angle that is not exactly perpendicular (oblique observation).

FIG. 7 further represents, in superposition, the contour of the incidence surfaces (or lens surfaces) S1 defining the location of the lenses LN1 located opposite the pixels 20. In this example, each lens LN1 is positioned in correspondence with the sub-pixels 22*b*, 22*c* and 22*d* of the associated pixel 20 and further covers part of the sub-pixel 22*a* of the associated pixel 20 (as well as part of the sub-pixel 22*a* of a neighboring pixel 20).

Also, in this particular example, each lens LN1 focuses the received incident light 30 (FIG. 4) on the sub-pixel 22*c* of the associated pixel 20, which has the consequence of greatly enhancing the color contribution of the sub-pixel 22*c*, in the corresponding region of the color image 6 (FIG. 1) generated through said lens LN1, with respect to the respective color contribution of each other sub-pixel 22*a*, 22*b* and 22*d* of the associated pixel 20.

Figure 8:
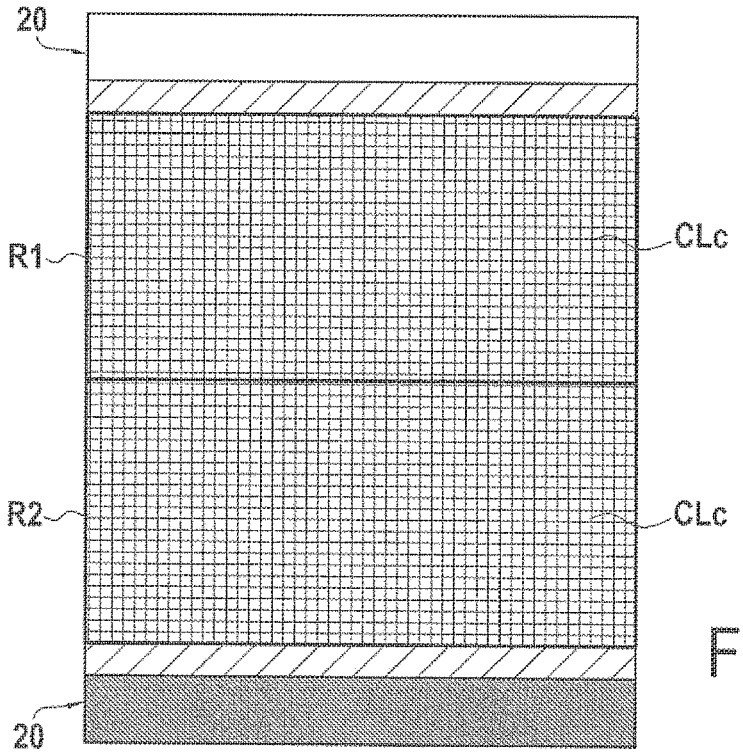
FIG. 8 is a top view schematically representing the visual appearance of an image generated by the document of FIG. 4, according to a particular embodiment of the invention.

FIG. 8 represents the visual rendering, in regions R1 and R2, of the color image 6 observable by an observer OB (FIG. 4). As represented, the regions R1 and R2 are observable in the single color CLc due to the focusing of the incident light 30 by the lenses LN1 on the sub-pixels 22*c*.

By preferentially converging the incident light 30 on some appropriately chosen sub-pixels 22, it is thus possible to generate (or reveal) the desired color image 6. The lenses LN1 allow selecting some colors so as to form the final color image 6 by the interaction between the array of lenses LN1 and the set of pixels 20.

The color image 6 is therefore formed by the combination of the array of lenses LN1 and the facing set of pixels 20. Without the addition of the lenses LN1 to judiciously orient the incident light, the set of pixels 20 is only a blank arrangement of color pixels insofar as this set lacks the information characterizing the color image 6. It is the array of lenses LN1 that is configured, according to the chosen arrangement of sub-pixels 22, to customize the visual appearance of the pixels 20 and thus generate the final color image 6.

In the example considered here, the lenses LN1 each converge the incident light 30 towards a single sub-pixel 22*c* of the same predetermined color CLc in the associated pixel 20, so as to make appear as a single color the color CLc in a monochrome region (for example image background 10) of the color image 6 (FIG. 1).

According to a particular example, the smallest dimension of the lenses LN1 is less than or equal to $350 \cdot 10^{-6}$ m, i.e. 350 μm. In the case where the lenses LN1 are of cylindrical shape as represented in FIGS. 5-7, the smallest dimension of the lenses corresponds to the smallest side of the rectangle formed by the intersection of the cylinder portion of the lens with the plane on which it rests.

According to a particular example, the arrangement of pixels 20 in document 2 represented in FIGS. 4 to 8 is such that the initial color contribution of a sub-pixel 22 in its pixel 20 (that is to say the intrinsic contribution of the color of this sub-pixel 22, independent of the lenses) is of 25% and its contribution in the corresponding region (corresponding to the incidence surface of the associated lens) of the final color image 6 is of 100%.

The invention therefore allows advantageously generating a color area highly saturated in the desired color CLc or even desaturated in the particular case where the targeted sub-pixel is white in color. Each lens LN1 masks the colors CLa, CLb, CLd of the other sub-pixels 22*a*, 22*b* and 22*d* of the associated pixel 20 in the corresponding region (R1 and R2) of the color image 10 generated through the lens. This masking is preferentially visible when the map is not tilted relative to the observer OB, that is to say, when we are in an observation normal to the plane in which the pixels extend. The observation may not be constrained to an exact normality if the convergence of the lenses allows having a smaller useful surface and centered on the targeted sub-pixel.

The invention thus allows forming monochrome image areas of good quality, while ensuring a high level of complexity guaranteeing the security of the image against fraud. The invention allows, for example, making an image background 10 (FIG. 1) that is highly saturated or desaturated in a given color, such as white for example.

By inspecting the color image 6, it is possible thanks to the invention to easily detect fraud when the image has been tampered or illegally reproduced. The configuration of the lenses is only adapted to the set of pixels 20 that has been printed and is therefore fixed in the image. Furthermore, this level of complexity and security of the image achieved thanks to the invention does not come at the expense of the quality of the visual rendering of the image. This does not prevent particularly the formation of color images comprising areas requiring high contrast as in the case of a face facing an image background. The invention allows forming quality color images from a large color gamut.

Alternatively, it is possible to configure the lenses LN1 so that they each focus the incident light 30 on a single sub-pixel 22 of the associated pixel 20, these sub-pixels 22 not being always necessarily of the same color. Various associations of colors are thus possible.

Furthermore, in the example represented in FIGS. 4-8, the lenses LN1 each focus the incident light on a single sub-pixel 22 of a facing associated pixel 20. Other embodiments are however possible in which the lenses focus the incident light on at least two sub-pixels of a single pixel, as described below.

A second particular implementation of the device 2, as described above with reference to FIGS. 1, 2 and 3A-3D, is now described with reference to FIGS. 9 to 13.

The device 2 here comprises a substrate 12 in which a set of pixels noted 40 is disposed, each pixel comprising a plurality of sub-pixels noted here 42. An array of lenses, noted here LN2, is disposed opposite the set of pixels 40 so as to generate the color image 6 (FIG. 1) by focusing an incident light 30 on some of the sub-pixels 42.

More particularly, the substrate 12 comprises an upper layer 12*a* disposed on a lower layer 12*b*, in a manner identical to the embodiment of FIGS. 4-5. The set of pixels 40 is printed on the upper face of the lower layer 12*b* or on the lower face of the upper layer 12*a*, so as to be at the interface between the layers 12*a* and 12*b*, inside the substrate 12. According to one variant, the set of pixels 40 is printed on the upper face of the substrate 12.

As already described in the previous examples, each pixel 40 forms a pattern including an arrangement of sub-pixels 22 of at least two different colors. The sub-pixels 22 can be made based on any color printing technique that those skilled in the art can choose depending on the case. The set of pixels 20 used in this example is described later with reference to FIG. 11.

In this example, lenses LN2 are formed in a layer 14 including surface deformations defining the lenses, in an identical manner to the embodiment of FIGS. 4-5. This layer 14 covers the substrate 12, the layer 14 and the substrate 12 being for example laminated together. The layer 14 can be made of silica glass, polycarbonate or any other transparent material. According to one variant, the array of lenses LN2 is formed directly in the substrate 12 which then includes surface deformations defining the lenses, no additional layer 14 then being necessary.

Figure 9:
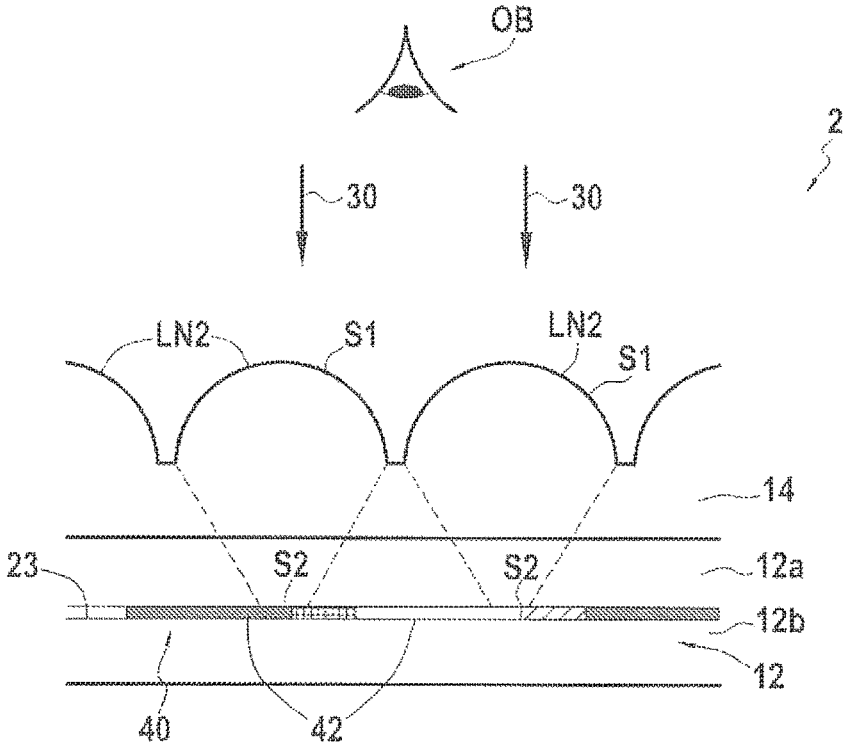
FIG. 9 is a sectional view along IX schematically representing a document according to a particular embodiment of the invention.
Figure 10:
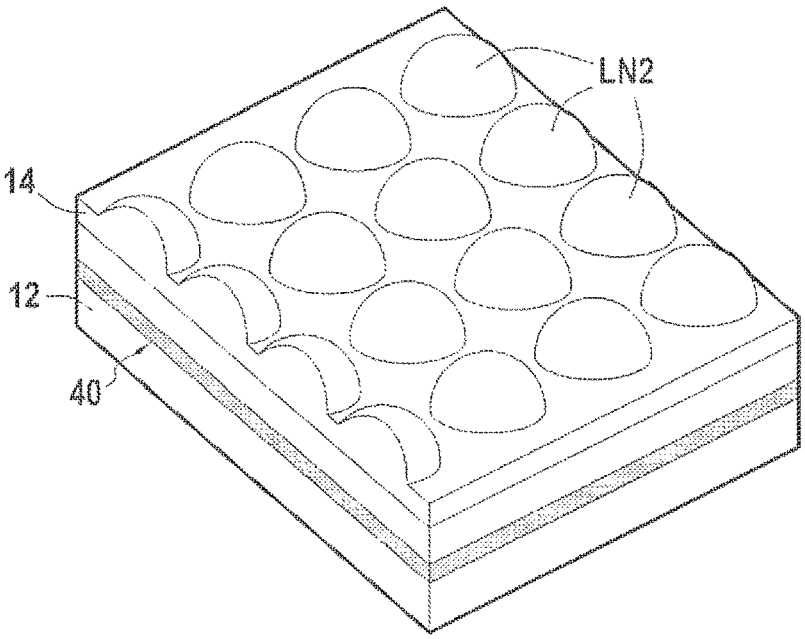
FIG. 10 is a perspective view schematically representing the document of FIG. 9, according to a particular embodiment of the invention.

As illustrated in FIG. 9-10, the lenses LN2 are here of spheroidal shape and together form a matrix of lenses LN2, composed for example of rows and orthogonal columns. However, it is possible to arrange the lenses LN2 in a non-orthogonal arrangement, or even in a non-regular way, depending on the sought visual effect.

The LN2 lenses are in this example converging lenses. The array (or arrangement) of lenses LN2 is disposed opposite the set of pixels 40 so as to generate the color image 6 by focusing an incident light 30 through the lenses LN2 on at least part of the sub-pixels 42. Each lens LN2 is positioned, relative to a facing associated pixel 40, to focus the incident light 30 on at least one of the sub-pixels 22 of the associated pixel 20 so as to modify (or modulate) the contribution of the respective colors of the sub-pixels 22 of the associated pixel 20, in a region of the color image 6 generated through said lens LN2, with respect to the pattern intrinsically formed by the associated pixel 40 independently of said lens LN2 (that is to say without taking into account the modulation effect of said lens).

In other words, each lens LN2 is positioned (or configured), relative to a facing associated pixel 40, to focus the incident light 30 on at least one of the sub-pixels 22 of the associated pixel 20 so as to modify (or modulate) the contribution of the respective color of at least one sub-pixel 22 of the associated pixel 20, in a corresponding region of the color image 6 generated through said lens LN2, with respect to the respective color contribution of each other sub-pixel 22 of said associated pixel 20.

As such, each lens can be shifted in a unique way with respect to the position of the pixels 20 according to the perfectly regular organization presented by way of example in FIG. 10.

As already explained, the substrate 12 and the layer 14 are transparent in order to allow the incident light 30 to pass at least partially through the lenses LN2 until reaching the color pixels 40. The pixels 40, and more particularly their sub-pixels 42, include in this example a reflecting surface 23, positioned under the sub-pixels 42, to reflect (at least partially) the received incident light 30 through the array of lenses LN2. The layers 12 and 14 are for example made of polycarbonate.

As represented in FIG. 9, and as already explained with reference to FIG. 4, each lens LN2 includes an incidence surface S1, able to receive an incident light 30, and further defines, at the surface of the set of pixels 40, a useful surface S2 on which the lens LN2 converges the incident light 30. Each lens LN2 is positioned opposite a pixel 40 associated therewith, the lens LN2 being disposed so that its useful surface S2 is positioned on at least part of two sub-pixels 42 of the associated pixel 40.

The lenses LN2 thus focus the received incident light 30 so as to enhance the color contribution of at least two sub-pixels 42 of the associated pixel 20, in the corresponding region of the color image generated through said lens, with respect to the respective color contribution of each other sub-pixel 42 of the associated pixel 40. This modulation of the colorimetric contributions of the sub-pixels is described in more detail below with reference to FIGS. 11 and 12.

Figure 11:
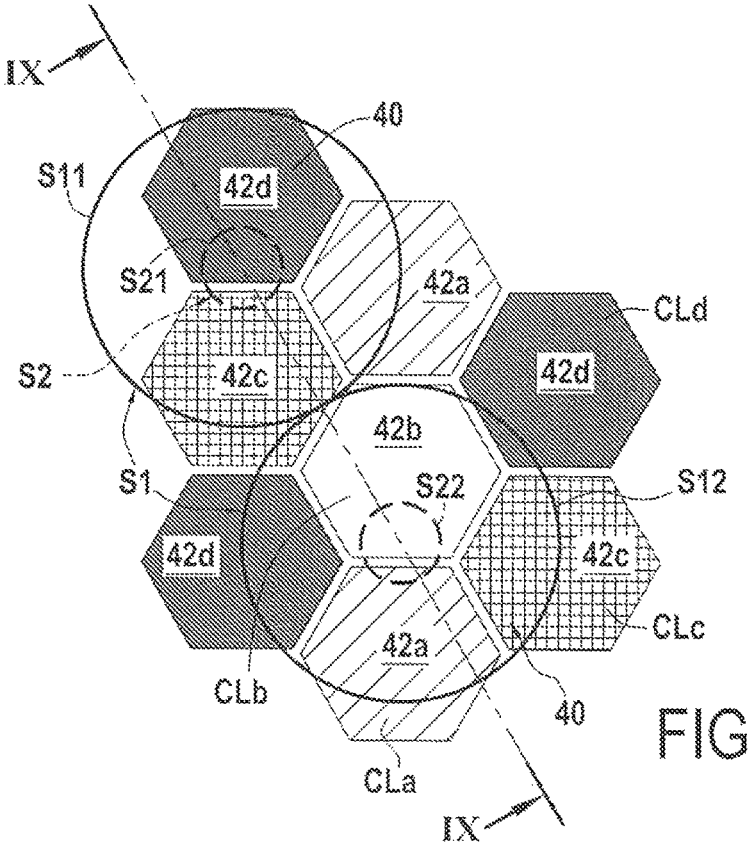
FIG. 11 is a top view schematically representing the set of pixels of the document of FIG. 9, according to a particular embodiment of the invention.

The set of pixels 40 used in the example considered here is illustrated in FIG. 11. The pixels 40 are here composed of 4 sub-pixels 42*a*-42*d* of hexagonal shape. Each sub-pixel 42*a*-42*d* of the same pixel 40 has a single color noted respectively CLa-CLd in the considered pixel. The sub-pixels 42 are uniformly distributed so that the colors CLa to CLd are repeated periodically in the substrate 12. This hexagonal configuration offers great flexibility in the range of the colors that can be produced. Other exemplary embodiments are possible with only 3 sub-pixels 42 of distinct color in each pixel 40 (see for example the variant represented in FIG. 3B).

FIG. 11 represents in dotted lines the useful surface S2 defined by each lens LN2 on an associated pixel 40. In this example, the useful surface S2 of each lens LN2 defines an area straddling two sub-pixels 42 of the facing associated pixel 40. In other variants, it is possible to configure lenses so that it focuses the incident light on 3 sub-pixels, or even more.

The incidence surfaces S1 define particularly the location of the lenses LN2 located opposite the pixels 40. These incidence surfaces S1 are dependent on the shape, the position, and more generally the configuration of the lenses LN2. In this example, each lens LN2 is positioned in correspondence with a part of some sub-pixels 42 of an associated pixel 40 and can, if necessary, also cover part of one or several neighboring pixel(s) 40.

More particularly, the case of two lenses LN2 defining respectively incidence surfaces S11 and S12, and useful surfaces S21 and S22 are considered here.

Also, in this particular example, each lens LN2 focuses the received incident light 30 (FIG. 9) on two sub-pixels 42 of the associated pixel 40 which has the consequence of greatly enhancing the color contribution of these sub-pixels, in the corresponding region of the color image 6 (FIG. 1), corresponding to the incidence surface S11, S12, generated through said lens LN2, with respect to the respective color contribution of each other sub-pixel 42 of the associated pixel 20.

Thus, in the example represented in FIG. 11, the area defined by the useful surface S21 is such that the colors CLc and CLd of the respective sub-pixels 42*c* and 42*d* are enhanced with respect to the colors of the other sub-pixels 42 of the considered pixel 40. Likewise, the area defined by the useful surface S22 is such that the colors CLa and CLb of the respective sub-pixels 42*a* and 42*b* are enhanced with respect to the colors of the other sub-pixels 42 of the considered pixel 40. By adapting the configuration of the lenses LN2, it is possible to control the shape and dimensions of the useful surfaces and thus to choose the colors preferred in each region of the image 6, and the proportions in which the colorimetric contributions of each sub-pixel 42 are modified.

Figure 12:
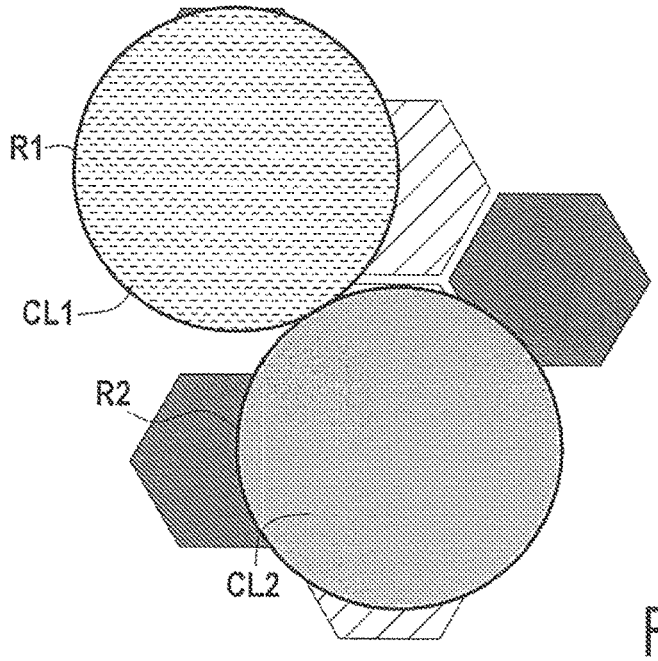
FIG. 12 is a top view schematically representing the visual appearance of an image generated by the document of FIG. 9, according to a particular embodiment of the invention.

FIG. 12 represents the visual rendering, in regions R1 and R2, of the color image 6 observable by an observer OB (FIG.

9). As represented, the regions R1 and R2, corresponding respectively to the incidence surfaces S11 and S12 of two lenses LN2, are observable in hybrid colors CL1 and CL2 obtained by mixtures of colors derived from the sub-pixels on which the incident light is focused 30.

Thus, region R1 presents the hybrid color CL1 resulting from an addition of the weighted contributions of the colors CLc and CLd of sub-pixels 42*c* and 42*d*. Likewise, the region R2 presents the hybrid color CL2 resulting from an addition of the weighted contributions of the colors CLa and CLb of sub-pixels 42*a* and 42*b*.

By preferably converging the incident light 30 on some sub-pixels 22 chosen appropriately, it is thus possible to generate (or reveal) the desired color image 6. The lenses LN2 allow generating complex colors from the colors of the sub-pixels located opposite the lenses. It is possible to generate a hybrid color from 2, 3 or 4 distinct sub-pixels for example, depending on the tiling used. As already explained, the color image 6 is therefore formed by the combination of the array of lenses LN2 and the facing set of pixels 40. Without the addition of the lenses LN2 to judiciously orient the incident light, the set of pixels 40 is only a blank arrangement of color pixels insofar as this set lacks the information characterizing the color image 6. It is the array of lenses LN2 that is configured, according to the arrangement of sub-pixels 42 chosen, to customize the visual appearance of the pixels 40 and thus generate the final color image 6.

It is noted that different types of visual rendering can be obtained when a lens converges an incident light on at least two sub-pixels. In the example considered above, it is assumed that the regions R1 and R2 of the color image 6 (FIG. 12) as they appear to an observer OB are monochrome. In other words, these regions R1 and R2 appear as areas having a single uniformly distributed color, namely the respective hybrid colors CL1 and CL2 in this example. To do so, it is necessary that the dimensions of the lenses LN2 are sufficiently small relative to the distance between the image and the observer so that the intrinsic resolving power of the human eye cannot distinguish the different primary colors constituting the hybrid colors CL1 and CL2, respectively. When the combination of distinct colors takes place beyond the resolving power of the human eye, only the hybrid color resulting from the additions of the constituent colors is perceived by an observer.

Figure 13:
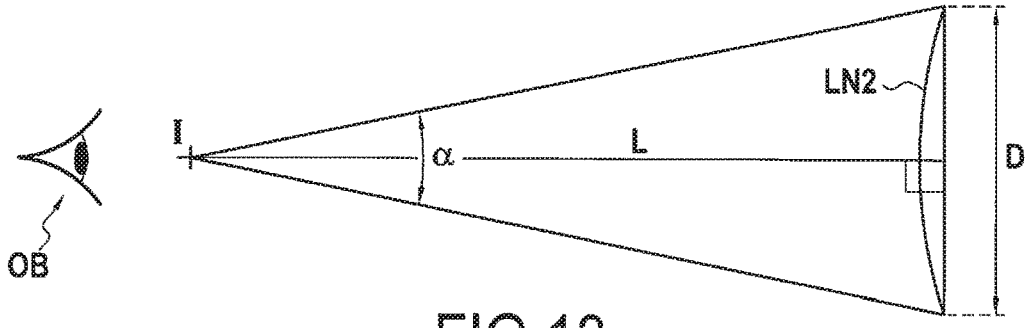
FIG. 13 is a sectional view schematically representing a document according to a particular embodiment of the invention.
Figure 14:
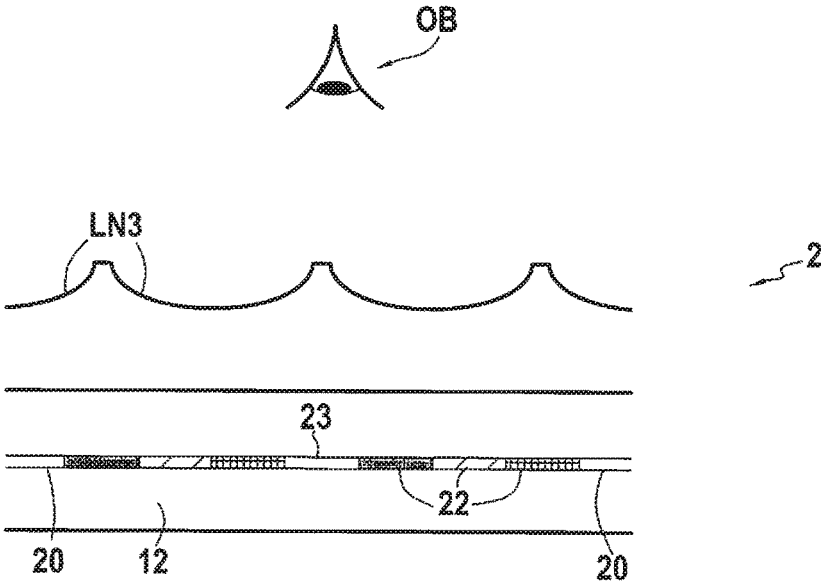
FIG. 14 is a sectional view schematically representing a document according to a particular embodiment of the invention.

FIG. 13 represents an observer OB observing from a point I a portion of an image projected on a lens LN2. According to a particular embodiment, the smallest dimension D of the lenses LN2 is such that:

$$D<\tan(\alpha\text{lim}/2)\cdot 2L$$

where αlim corresponds to the maximum limit angle of observation beyond which the human eye cannot distinguish two distinct colors, and L is the distance between the point of observation I and the image. Note that the smallest dimension of D is comprised in a plane in which the considered lens LN2 extends.

So that a human eye cannot separately distinguish the different colors of the sub-pixels 40 in an image area defined by a useful surface S1 (FIG. 11), it is necessary that the angle of observation a is such that:

$$\alpha<\alpha\text{lim}$$

It is considered here that αlim=1' (minute)=$3.10^{-4}$ rad.

According to a particular example, assuming that the observation distance L=0.5 m (meter), it is necessary that the smallest dimension D of the lenses LN2 is less than $150.10^{-6}$ m, or 150 μm. In the case where the lenses LN2 are of spheroidal shape, the smallest dimension D corresponds to the diameter of the circle formed by the intersection of the sphere portion of the lens with the plane on which it rests.

It will be noted that in the exemplary embodiments described above, the lenses used are converging, although other embodiments are possible. Thus, it is thus possible to apply the principle of the invention by using diverging lenses. For example, in document 2 represented in FIG. 2, the array of lenses LN may comprise at least one diverging lens configured to diverge a received incident light by the lens so as to reduce the color contribution by at least one sub-pixel 22 of the associated pixel 20, in the corresponding region of the color image 6 generated through said lens, with respect to the respective color contribution of each other sub-pixel 22 of said associated pixel 20.

FIG. 13 represents a sectional view of document 2 according to one variant of the embodiment represented in FIG. 2. Document 2 differs from the implementation of FIG. 2 in that the lenses, noted here LN3, are diverging so that they diverge the incident light on the sub-pixels 22 located in correspondence. It is thus possible to position the diverging lenses LN3 in correspondence with some sub-pixels 22 so as to reduce the color contribution of these sub-pixels in the regions of the color image 6 generated through these lenses. With reference to FIG. 11, it is possible to consider an exemplary embodiment where S21 and S22 define the incidence surfaces of diverging lenses LN3, and S11 and S22 define the useful surfaces of these lenses.

According to this variant, it is also possible to modify (modulate) the color contribution of some sub-pixels with respect to others in the rendering of the final color image 6, according to the principle of the invention.

Moreover, as already indicated, it is possible to impart contrast to a color image 6 (FIG. 1) generated according to the principle of the invention by adding opacifying (black or dark) elements opposite some sub-pixels in order to create gray scale of the color image 6, as described below.

Figure 15:
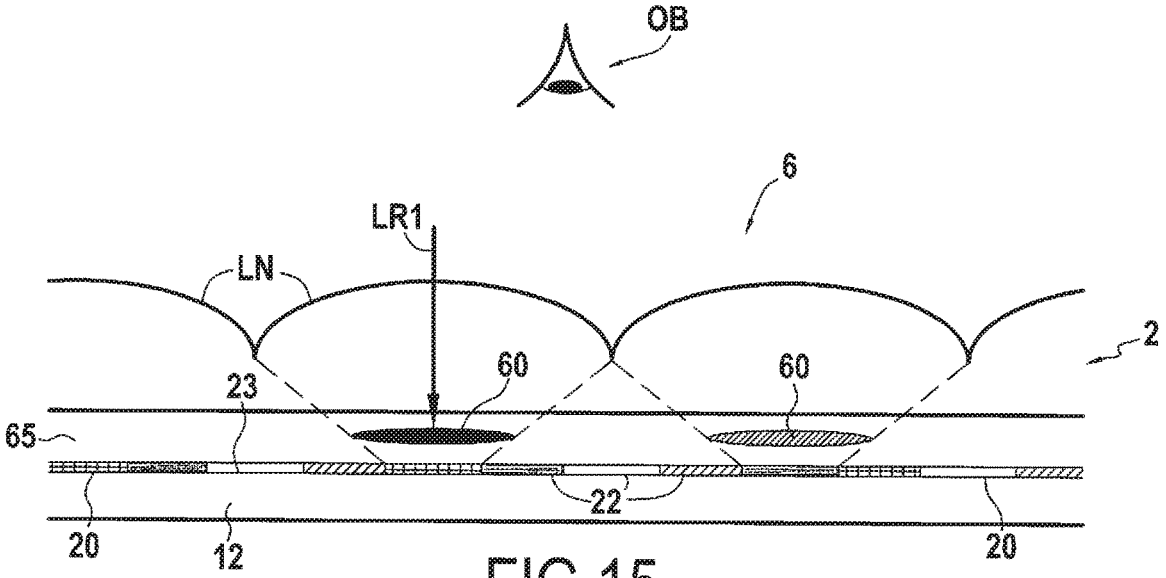
FIG. 15 is a sectional view schematically representing a document according to a particular embodiment of the invention.

FIG. 15 represents a particular embodiment which differs from the embodiment of FIG. 2 in that document 2 further comprises opaque (or opacifying) or non-reflecting areas (or volumes) 60, which may be dark or gray or black for example, located opposite some sub-pixels 22 so as to create gray levels in the final color image 6. To do so, the substrate 12 comprises for example a transparent laserable layer 65 (corresponding for example to the layer 12*a* represented in FIGS. 4 and 9). It is meant here by "Laserable" layer a layer sensitive to a laser radiation.

The transparent laserable layer 65 is disposed opposite the set of pixels 20, this transparent laserable layer being at least partially carbonized by a laser radiation LR1 so as to comprise regions 60 opacified locally opposite sub-pixels 20 to produce gray levels (or contrast) in the color image 6 generated through the lenses LN.

The opaque regions 60 partially or totally mask some of the sub-pixels 22 (a subset of the sub-pixels 22) thus forming the gray levels of the color image 6. These opaque regions can also partially or totally mask the lenses, thus making it possible to modulate, that is to say vary, the luminosity of compound colors, created by the alignment of the lenses and the sub-pixels.

By combining this technique of local opacification of a laserable layer with the principle of the invention based on the use of lenses disposed opposite color sub-pixels, it is possible to obtain customized color images of good quality, while guaranteeing a high level of security against fraud due to the particularly advanced complexity of the image.

In the example represented in FIG. 15, the opaque areas 60 are formed so as to cover the whole of a corresponding sub-pixel 22, although other embodiments are possible where, for example, at least some of these opaque areas 60 cover only part of the corresponding sub-pixel 22. It is thus possible to adapt in a very precise manner the gray levels in the image 6 (FIG. 1).

According to a particular example, one or several opaque region(s) 60 are configured so as to partially (or even totally) mask a respective area of the arrangement of pixels 20 visible through a facing associated lens LN. The set of the opaque regions 60 can form a general pattern such as an inscription (for example characters or symbols, such as a name or the like) or an image. This general pattern is then visible through the lenses LN.

The invention also relates to a method for generating (or forming) a color image according to the principle of the invention. This generation method can be configured to produce a device (or a document) according to any one of the embodiments described in this document.

A method for generating (or forming) the document 2 represented in FIG. 2 is now described with reference to FIG. 16.

The method comprises the following steps:

printing (step E2) a set of pixels 20 on or in the substrate 12, each pixel 20 forming a pattern including an arrangement of sub-pixels 22 of at least two different colors; and forming (step E4) an array of lenses LN disposed opposite the set of pixels 20 so as to generate the color image 6 (FIG. 1) by focusing or diverging an incident light through the lenses on at least part of the sub-pixels 22. In the example represented in FIG. 2, the lenses LN are converging, so that they focus the incident light on the sub-pixels 22.

The formation step E4 is such that each lens LN is positioned, relative to a facing associated pixel 20, to focus (or, alternatively, to diverge) the incident light on at least one of the sub-pixels 22 of said associated pixel 20 so as to modify the contribution of the respective colors of the sub-pixels of the associated pixel, in a region of the color image 6 generated through said lens, with respect to the pattern intrinsically formed by the associated pixel 20 independently of said lens 20.

In a particular example, step E4 of forming the lenses LN comprises:

providing a first transparent layer; and projecting on this first transparent layer a laser radiation (distinct from the radiation LR1 represented in FIG. 15) so as to form the lenses LN by surface deformation of said first transparent layer.

According to one variant, a projection of transparent material is made on the first transparent layer using a printer head 3D so as to form lenses on the surface of the first transparent layer.

This first transparent layer can correspond, for example, to the layer 14 represented in FIGS. 4 and 9 or to the substrate 12 itself in the case where the lenses LN are formed directly in the substrate.

For example, $CO_2$-type laser radiation can for example be used to create the surface deformations necessary to form the array of lenses LN.

According to a particular example, during the formation step E4, each lens LN (FIG. 2) is positioned relative to the associated pixel 20 independently of the positioning of the other lenses LN of the array of lenses. This positioning is for example carried out using a camera capable of identifying, for each lens, the adapted position with respect to the associated pixel 20.

The method may further comprise a step E5 of forming opaque areas 60 to create gray levels in the final image, as already explained with reference to FIG. 15.

Figure 17:
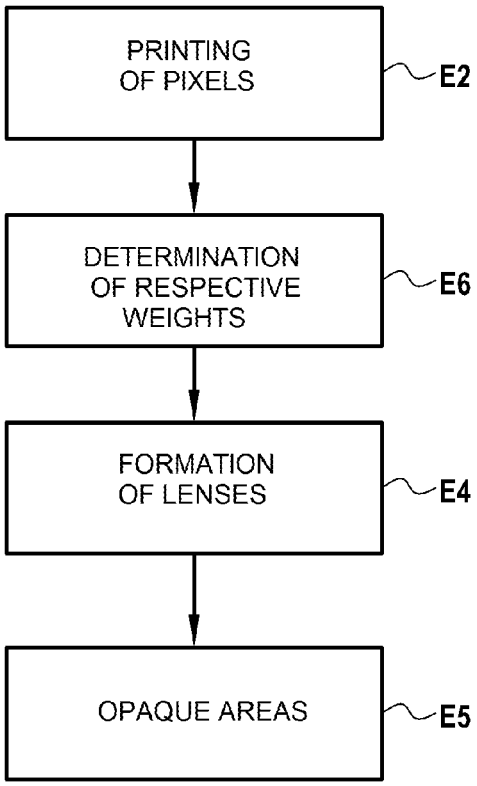
FIG. 17 represents, in the form of a diagram, the steps of a method for generating a color image, according to a particular embodiment of the invention.

As represented in FIG. 17, the method may further comprise, prior to the formation step E4, a step E6 of calculating whether at least one of the lenses LN must be configured to focus the incident light on at least two sub-pixels, as represented for example in FIGS. 11 and 12, to create a hybrid color.

During this calculation step E6, carried out by a calculation unit such as a computer for example, the respective weights (or respective proportions or respective weighting coefficients) of each color constituting a hybrid color desired to be obtained are determined and the positioning of the corresponding lens LN (and particularly the position of its useful surface) with respect to the sub-pixels of the associated pixel is determined from these weights.

Thus, in a particular mode, at least one lens LN, called first lens, of the array of lenses is a converging lens configured to focus the received incident light on at least two sub-pixels 42 of the associated pixel 40 (FIGS. 9-12) so as to make appear in a corresponding region R1, R2 of the color image 6 a hybrid color CL1, CL2 resulting from a combination of the colors of said at least two sub-pixels, in which said first lens LN is formed so that it has, in its smallest dimension, a smaller maximum dimension of 150 μm. The generation method then comprises a determination (E6) of respective weights assigned to each of said at least two sub-pixels 42, these weights representing respective contributions of each sub-pixel 42 in the color combination producing the hybrid color; the first lens being positioned relative to the associated pixel 40 in accordance with said respective weights assigned to said at least two sub-pixels 42.

As already indicated, the method (FIG. 17) can further comprise a step E5 of forming opaque areas 60 to create gray levels in the final image, as already explained with reference to FIG. 15.

As indicated in the various exemplary embodiments envisaged above, many variants and adaptations are possible within the framework of the invention. Particularly, those skilled in the art can envisage many configurations of the lenses. Likewise, many arrangements of pixels are possible depending on the case.

Figure 16:
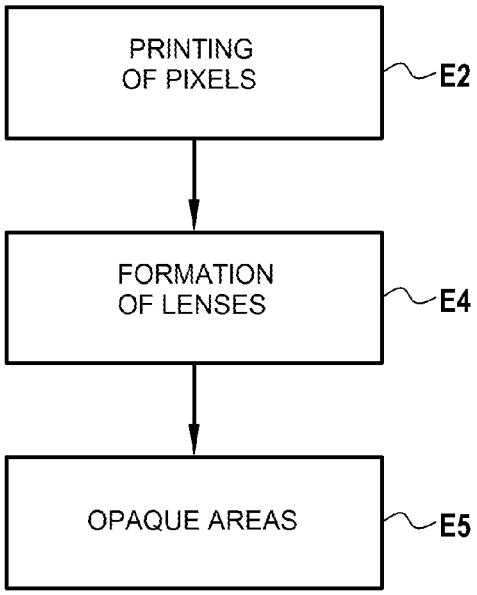
FIG. 16 represents, in the form of a diagram, the steps of a method for generating a color image, according to a particular embodiment of the invention.

The order in which the steps are carried out in FIGS. 16 and 17 can be adapted depending on the case.

According to a particular embodiment, each lens of the document of the invention is associated with a single pixel. The image 6 (FIG. 1) is thus formed by n lens/associated pixel pair(s), n being an integer greater than or equal to 1.

Those skilled in the art will understand that the embodiments and variants described above constitute only non-limiting examples of implementation of the invention. Particularly, those skilled in the art will be able to envisage any adaptation or combination among the characteristics and embodiments described above in order to meet a very specific need.

Thus, it is possible to use, for example, diverging lenses in the embodiments of FIGS. 4 and 9 or spheroidal lenses in the embodiment of FIG. 4 or cylindrical lenses in the embodiment of FIG. 9. Different tilings of pixels are possible in each of the embodiments described in this document. The different variants described with reference to each embodiment can be applied to the other embodiments.

The invention claimed is:

1. A document suitable to generate a color image, comprising:

a set of pixels printed on or in a substrate, each pixel forming a pattern including an arrangement of sub-pixels, each sub-pixel having a respective color; and an array of lenses disposed opposite the set of pixels so as to generate the color image by focusing or diverging an incident light through the lenses on at least part of the sub-pixels, each lens being positioned, relative to a facing associated pixel, to focus or diverge the incident light on at least one sub-pixel of said associated pixel so as to modify a color contribution of the at least one sub-pixel of the associated pixel, in a region of the color image generated through said lens, with respect to the pattern formed by the associated pixel independently of said lens, and wherein the sub-pixels in the set of pixels include a reflecting surface positioned under the sub-pixels to reflect the incident light through the array of lenses.

2. The document according to claim 1, wherein each pixel of said set of pixels forms an identical pattern of color sub-pixels.

3. The document according to claim 1, wherein the set of pixels is configured so that the sub-pixels are uniformly distributed on or in the substrate.

4. The document according to claim 1, wherein a probability density of the presence of each sub-pixel color is constant in the set of pixels.

5. The document according to claim 1, wherein the array of lenses is formed from a layer including surface deformations defining the micro-lenses, said layer being the substrate or a layer laminated with the substrate.

6. The document according to claim 1, wherein at least one lens in the array of lenses is a converging lens configured to focus the incident light so as to enhance the color contribution of the at least one sub-pixel of the associated pixel, in the region of the color image generated through said lens, with respect to a respective color contribution of each other sub-pixel of said associated pixel.

7. The document according to claim 6, wherein at least one lens in the array of lenses is a converging lens configured to focus the incident light on only one of the at least one sub-pixels of the associated pixel so as to mask a respective color of each other sub-pixel of said associated pixel in the region of the color image generated through said lens.

8. The document according to claim 7, wherein, in a monochrome region of the color image, the monochrome region being of a predetermined color, each lens of the array of lenses is a converging lens configured to focus the incident light on a single sub-pixel, of the same predetermined color as the monochrome region, in the associated pixel, so as to display the predetermined color through said array of lenses in said monochrome region of the color image.

9. The document according to claim 6, wherein at least a first lens of the array of lenses is a converging lens configured to focus the incident light on at least two sub-pixels of the associated pixel so as to display through said array of lenses in a corresponding region of the color image a hybrid color resulting from a combination of colors of said at least two sub pixels, wherein a smallest dimension of said first lens is less than 150 μm.

10. The document according to claim 1, wherein at least one lens of the array of lenses is a diverging lens configured to diverge the incident light by the lens so as to reduce the color contribution of the at least one sub-pixel of the associated pixel, in the region of the color image generated through said lens, with respect to a respective color contribution of each other sub-pixel of said associated pixel.

11. The document according to claim 1, further comprising:

a transparent laserable layer disposed opposite the set of pixels, said transparent laserable layer being at least partially carbonized by laser radiation so as to comprise locally opacified regions opposite sub-pixels to produce gray levels in the color image generated through the lenses.

12. The document according to claim 1, wherein the document is an identity card, a credit card, a passport, a driving license, or a secure entry badge.

13. A method for generating a color image, comprising:

printing a set of pixels on or in a substrate, each pixel forming a pattern including an arrangement of sub-pixels, each sub-pixel having a respective color; and forming an array of lenses disposed opposite the set of pixels so as to generate the color image by focusing or diverging an incident light through the lenses on at least part of the sub-pixels, each lens being positioned, relative to a facing associated pixel, to focus or diverge the incident light on at least one sub-pixels of said associated pixel so as to modify a color contribution of the at least one sub-pixels of the associated pixel, in a region of the color image generated through said lens, with respect to the pattern formed by the associated pixel independently of said lens, and wherein the sub-pixels in the set of pixels include a reflecting surface positioned under the sub-pixels to reflect the incident light through the array of lenses.

14. The method according to claim 13, comprising:

providing a first transparent layer; and projecting on the first transparent layer a first laser radiation so as to form the lenses by surface deformation of said first transparent layer.

15. The method according to claim 13, comprising:

providing a first transparent layer; and making on the first transparent layer a projection of transparent material by using a 3D printer head so as to form the lenses on the surface of the first transparent layer.

16. The method according to claim 13, wherein, during the formation of the array of lenses, each lens is positioned relative to the facing associated pixel independently of the positioning of other lenses of said array of lenses.

17. The method according to claim 13, wherein at least a first lens of the array of lenses is a converging lens configured to focus the incident light on at least two sub-pixels of the associated pixel so as to display through said array of lenses in a corresponding region of the color image a hybrid color resulting from a combination of colors of said at least two sub-pixels, wherein a smallest dimension of said first lens is less than 150 μm.

18. The method according to claim 17, comprising determining respective weights assigned to each of said at least two sub-pixels, said weights representing respective contributions of each sub-pixel in the combination of the colors producing the hybrid color;

said first lens being configured relative to the associated pixel in accordance with said respective weights assigned to said at least two sub-pixels.

19. The method according to claim 13, wherein the substrate is provided in a document.

20. A document suitable to generate a color image, comprising:

a set of pixels printed on or in a substrate, each pixel forming a pattern including an arrangement of sub-pixels, each sub-pixel having a respective color; and an array of lenses disposed opposite the set of pixels so as to generate the color image by focusing or diverging an incident light through the lenses on at least part of the sub-pixels, each lens being positioned, relative to a facing associated pixel, to focus or diverge the incident light on at least one sub-pixel of said associated pixel so as to modify a color contribution of the at least one sub-pixel of the associated pixel, in a region of the color image generated through said lens, with respect to the pattern formed by the associated pixel independently of said lens, and wherein at least one lens in the array of lenses is a converging lens configured to focus the incident light so as to enhance a color contribution of the at least one sub-pixel of the associated pixel, in the region of the color image generated through said lens, with respect to a respective color contribution of each other sub-pixel of said associated pixel.

* * * * *